US005338212A

United States Patent [19]

Kerrigan

[11] Patent Number: 5,338,212

[45] Date of Patent: Aug. 16, 1994

[54] POWER CORD LOCK

[76] Inventor: Peter J. Kerrigan, 11709 Newbridge Ct., Reston, Va. 22091

[21] Appl. No.: 109,243

[22] Filed: Aug. 20, 1993

[51] Int. Cl.[5] ..... H01R 13/44

[52] U.S. Cl. ..... 439/134; 70/57

[58] Field of Search ..... 439/133–135, 439/304; 70/57, 58, 360

[56] References Cited

U.S. PATENT DOCUMENTS

| | | | |
|---|---|---|---|
| 4,413,488 | 11/1983 | Harmison, Jr. | 439/133 |
| 4,445,738 | 5/1984 | Wiencke | 439/133 |
| 4,592,607 | 6/1986 | Pejovic | 439/133 |
| 4,640,107 | 2/1987 | Slade | 439/133 |
| 4,673,230 | 6/1987 | Baumgart | 439/135 |
| 4,812,131 | 3/1989 | Sieverman | 439/134 |
| 5,052,939 | 10/1991 | Koch | 439/133 |

*Primary Examiner*—Gary F. Paumen

[57] ABSTRACT

The Power Cord Lock provides an inexpensive and easily manufactured apparatus to deter the unauthorized use of electrical or electronic equipment by preventing the power cord plug from being inserted into an electrical outlet. The plug is locked by inserting the prongs of the plug into holes in the center block which are sized and positioned to accept known standard two or three prong plug configurations. The plug is secured in the center block by folding two flexible straps attached to the sides of the center block around the plug and power cord and inserting the shackle of a padlock around the power cord through one of several pairs of parallel holes in the straps such that the prongs of the plug cannot be withdrawn from the center block. The flexibility of the straps and the spacing and shape of the sets of holes allow the device to be used with a range of plug cross sections and lengths. When the device is not in use, it can also be secured to the power cord by just locking the straps around the cord without inserting the power cord plug into the center block.

2 Claims, 1 Drawing Sheet

POWER CORD LOCK

SUMMARY

The Power Cord Lock is used to inhibit the unauthorized use of electrical or electronic equipment by precluding the plug end of the equipment power cord from being inserted into an electrical outlet, thereby eliminating power to the equipment and rendering the equipment inoperative. The Power Cord Lock may be used for safety, such as precluding children or unqualified persons from using electrical power tools which can inflict injury; security, such as precluding unauthorized persons from operating and possibly damaging sensitive equipment, or the contamination, compromise, or deletion of data or information; privacy, such as precluding access to personal or business information stored on electrical equipment; or parental control, such as precluding unauthorized watching of television during absence of the parents.

DRAWING

One view of the Power Cord Lock (FIG. 1) is enclosed which is believed to be sufficient to provide full perspective.

DETAILED DESCRIPTION

Procedure

Figure 1:
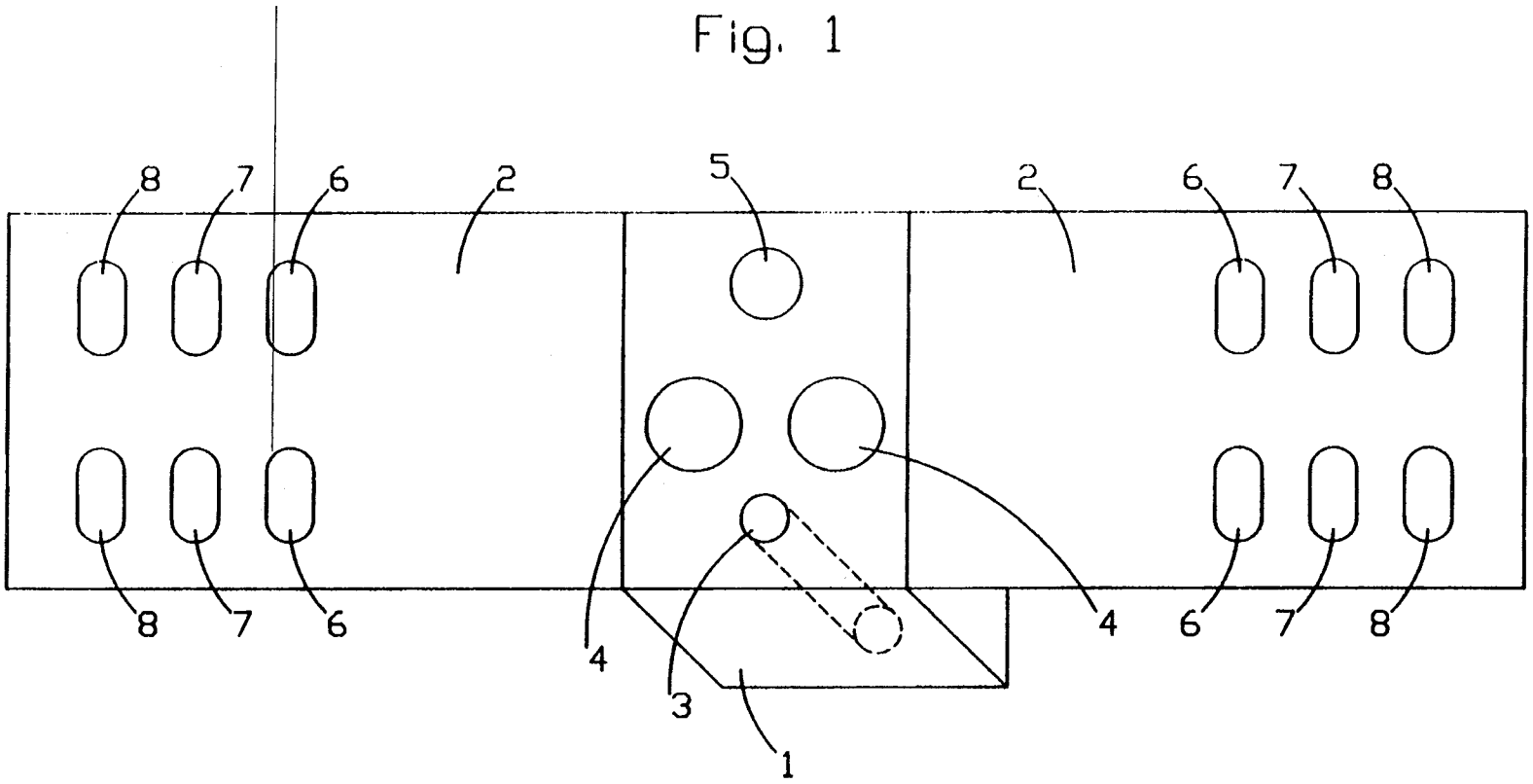

The Power Cord Lock is installed by inserting the prongs of the power cord plug into holes 3 4 5 in the center block 1 of the Power Cord Lock. The height of the center block 1 prevents the prongs from protruding out the other side. The two flexible straps 2 are then folded up around opposite sides of the plug and the electrical cord exiting from the plug. The shackle of any appropriately sized padlock is the passed through one side of both straps 2 through the set of holes 6 7 8 closest to the plug. The shackle is then passed through the other side of both straps 2 through the corresponding set of holes 6 7 8 with the cord between the holes. The plug now cannot be withdrawn from the center block 1. Locking the padlock precludes the shackle from being withdrawn from the straps 2. When the plug is in use, the device can be secured to the electrical cord with the padlock by the same procedure but without inserting the plug into the center block 1.

Description

The Power Cord Lock is a one piece unit comprised of a center block 1 and two flexible straps 2 of the same width as the center block 1 and attached to opposite sides of the center block 1 at the edges of a common face of the block. A set of holes 3 4 5 is drilled or molded through the center block 1 perpendicular to the face with edges in common with the straps 2. The size and position of these holes 3 4 5 allow known standard two or three prong plugs with prongs of known standard cross section to be plugged into the center block 1. The holes 3 4 5 are drilled or molded completely through the center block i such that the prongs of a plug can be inserted into the center block 1 from either of the opposite faces. The straps 2 have three rows of matching pairs of holes 6 7 8 parallel to the edge of the center block 1. These holes 6 7 8 are elongated with the long axis of the holes 6 7 8 parallel to the edge of the center block 1 such that padlocks with a range of shackle widths may be used. The spacing of the rows of holes 6 7 8 along the straps, in conjunction with the height of the center block i and the ability to insert the plug into either side, provides the capability to vary the position of the padlock every one-fourth inch to accommodate plug lengths from three-quarters of an inch to two and three-quarters inches.

Composition

The Power Cord Lock is specifically developed for inexpensive mass production and ease of packaging and distribution. It will generally be made of strong but flexible and light plastic. The flexibility of the straps 2 will facilitate packaging in either blister packs or ziplock bags. Where greater security is required, the Power Cord Lock can be manufactured from metal.

Dimensions

The overall dimensions are 8 inches long by 2 inches wide by $\frac{3}{4}$ inch high. The center block 1 is $1\frac{1}{2}$ inches by 2 inches by $\frac{3}{4}$ inch high. Each of the two straps 2 is $3\frac{1}{4}$ inches long by 2 inches wide. The thickness of the straps 2 will depend on the material used but will normally be between 1/32 and $\frac{1}{8}$ inch. The center block 1 has a $\frac{1}{4}$ inch diameter hole 3 centered $\frac{3}{8}$ inch from one $1\frac{1}{2}$ inches edge and $\frac{3}{4}$ inch from each 2 inch edge, two $\frac{1}{2}$ inch diameter holes 4 each centered $\frac{7}{8}$ inch from the same $1\frac{1}{2}$ inch edge as above and one centered $\frac{3}{8}$ inch from one 2 inch edge and one centered $\frac{3}{8}$ inch from the opposite 2 inch edge, and one $\frac{3}{8}$ inch diameter hole 5 centered $\frac{3}{8}$ inch from the $1\frac{1}{2}$ inch edge opposite the one above and $\frac{3}{4}$ inch from each 2 inch edge. Each strap 2 has three sets of two elongated holes 6 7 8 centered on three lines parallel to the edge of the center block 1 with the longer axis of the elongated holes lying along the lines. The center lines for the first pair of holes 6 are $1\frac{3}{4}$ inches, the center lines for the second pair of holes 7 are $2\frac{1}{4}$ inches, and the center lines for the third pair of holes 8 are $2\frac{3}{4}$ inches from the edge of the center block 1. The holes 6 7 8 are $\frac{1}{2}$ inch long and $\frac{1}{4}$ inch wide with one hole in each set 6 7 8 centered $\frac{1}{2}$ inch from each side of the strap 2.

I claim:

1. A power cord lock which precludes a plug of a power cord of electrical and electronic units from being plugged into an electrical outlet, said lock comprising a center block with holes into which the plug can be inserted; and flexible straps, which each have sets of pairs of holes and are attached to either side of the center block, and which cooperate with a padlock to secure the plug in the center block or to secure the power cord lock to the cord when not securing the plug, wherein the center block holes are positioned and sized to accommodate known standard two-prong and three-prong plug configurations, said center block holes having a height to preclude said prongs from protruding out of the opposite side of the center block, said prongs being insertable into either of two opposite sides of the center block.

2. The power cord lock of claim 1, wherein said pairs of strap holes are specifically positioned, sized, and shaped to secure, in cooperation with any padlock with a range of shackle sizes and widths, a broad range of plug sizes and shapes.

* * * * *